US009576451B2

(12) United States Patent
Edmonds

(10) Patent No.: US 9,576,451 B2
(45) Date of Patent: Feb. 21, 2017

(54) ELECTRONIC DEVICE WITH TAMPER RESISTANT ENCLOSURE

(71) Applicant: Johnson Electric S.A., Murten (CH)

(72) Inventor: Martin Wallace Edmonds, East Cowes (GB)

(73) Assignee: JOHNSON ELECTRIC S.A., Murten (CH)

( * ) Notice: Subject to any disclaimer, the term of this patent is extended or adjusted under 35 U.S.C. 154(b) by 71 days.

(21) Appl. No.: 14/096,633

(22) Filed: Dec. 4, 2013

(65) Prior Publication Data

US 2014/0184415 A1 Jul. 3, 2014

(30) Foreign Application Priority Data

Dec. 28, 2012 (GB) ..... 1223471.2

(51) Int. Cl.
*G08B 13/18* (2006.01)
*G08B 13/12* (2006.01)
*G07F 7/08* (2006.01)

(52) U.S. Cl.
CPC ..... *G08B 13/128* (2013.01); *G07F 7/0873* (2013.01)

(58) Field of Classification Search
CPC .... G06F 3/0202; G06F 1/1662; G06F 1/1626; G06F 1/169; G06F 3/023; H04M 1/23; H04M 2250/70; H01H 13/702; H01H 13/705
See application file for complete search history.

(56) References Cited

U.S. PATENT DOCUMENTS

| | | | | |
|---|---|---|---|---|
| 7,832,628 | B2 | 11/2010 | Mittler | |
| 2006/0119487 | A1* | 6/2006 | Atkinson | G06Q 20/206 340/13.25 |
| 2007/0152042 | A1 | 7/2007 | Mittler | |
| 2009/0184850 | A1* | 7/2009 | Schulz | G06F 1/1626 341/22 |
| 2010/0102127 | A1 | 4/2010 | Bonnet et al. | |
| 2011/0100788 | A1 | 5/2011 | Eck et al. | |
| 2011/0248860 | A1* | 10/2011 | Avital | H05K 1/0275 340/652 |
| 2012/0047374 | A1 | 2/2012 | Klum et al. | |

FOREIGN PATENT DOCUMENTS

| | | |
|---|---|---|
| DE | 4312905 | 10/1994 |

* cited by examiner

*Primary Examiner* — James Yang
(74) *Attorney, Agent, or Firm* — Muncy, Geissler, Olds & Lowe, P.C.

(57) ABSTRACT

A tampering resistant device has housing, a circuit board fitted with electronic components, and a key pad for command input. A security wrap is disposed between the circuit board and the key pad. The security wrap has a substrate and a security screen formed thereon and connected to a first alarm. The security screen has a conductive trace extending over the substrate between a pair of screen terminals that are electrically connected to respective alarm terminals. An alarm switch is located between the substrate and the circuit board and connected to a second alarm. The alarm switch is held closed by a spigot pressing on the alarm switch through the substrate. The spigot extends from the housing and releases the alarm switch when the housing is opened.

18 Claims, 4 Drawing Sheets

ELECTRONIC DEVICE WITH TAMPER RESISTANT ENCLOSURE

CROSS REFERENCE TO RELATED APPLICATION(S)

This application claims the benefit of British patent application serial no. GB 1223471.2, filed on Dec. 28, 2012. The entire content of the aforementioned patent application is hereby incorporated by reference for all purposes.

FIELD OF THE INVENTION

This invention relates to an electronic device and in particular, to an electronic device having a tamper resistant enclosure.

BACKGROUND OF THE INVENTION

Many electronic devices are used to transfer or store sensitive information. For example, a card reader may read, process, and at least temporarily store data related to credit cards, bank accounts and pin numbers and transfer data to a computer for the purpose of conducting a transaction. These devices may be subjected to tampering.

A cover may prevent tampering and/or provide evidence that a tampering has been tempted. One such device, disclosed in German Patent DE4312905, provides a flexible substrate that has a number of conductors forming one or more electrical circuits, disposed between a key pad and a PCB. The conductors have a narrow width and are finely spaced and spread over the substrate so as to form a barrier against forming a hole in the substrate without severing a conductor. The conductors are connected to an alarm circuit which is triggered by a conductor being severed. The response to the triggering of the alarm depends on the arrangement of the alarm circuit and may range from simply raising an alarm indication to disabling the protected circuit, or completely erasing data stored in the device. Key switches are arranged to be operated by depressing keys of the key pad which cause momentary deformation of the security device to allow conductive portions formed on the security device to short across or electrically interconnect selected conductive tracks of the PCB. Alarm switches are provided which function in a similar manner to the key switches and are held in the closed position by spigots formed on a housing containing the PCB to raise an alarm condition when the housing is opened.

A similar design is disclosed in US published patent application no. U.S. 2011/0100788A1, in which the protection device is connected to the circuit board via two normally open switch contacts. This design requires the protected circuit to be at all times enclosed by a secondary housing that applies a force against the protection device to resiliently deform a part of a substrate of the protection device to continually maintain the switches in the closed condition, so that the alarm circuit will be immediately triggered by opening of the housing. In this design the alarm switches are used to electrically connect the conductor(s) of the protection device to the security terminals of the PCB. Opening the housing would open the switch and trigger the security alarm. However, as there is only one type of alarm trigger, even if there is more than one trip switch, there is no indication of what caused the alarm to trigger, e.g., opening of the housing or damage to the conductor.

Hence there is a desire for a simplified device for protecting an electronic circuit incorporating a keyboard.

SUMMARY OF THE INVENTION

Accordingly, in one aspect thereof, the present invention provides an electronic device comprising a housing, a circuit board, a security wrap, a first dome and a spigot. The housing including a cover. The circuit board is disposed within the housing and has a pair of alarm contacts. The alarm circuit is disposed on the circuit board and is coupled to the pair of alarm contacts. The security wrap is interposed between the key pad and the circuit board and comprises a flexible substrate, a pair of screen terminals and an electrically conductive trace. The electrically conductive trace extends between the pair of screen terminals disposed on the flexible substrate. The adhesive layer covers the flexible substrate and bonds the flexible substrate to the circuit board. The pair of conductive paths extends through the adhesive layer to electrically connect the pair of screen terminals to the alarm circuit. The first dome is disposed between the security wrap and the circuit board and is aligned with the pair of alarm contacts. The spigot is formed on the housing, aligned with the first dome and applies a pressure on the flexible substrate of the security wrap to press the first dome against the pair of alarm contacts while the housing is closed.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale.

DETAILED DESCRIPTION OF THE PREFERRED EMBODIMENTS

Figure 1:
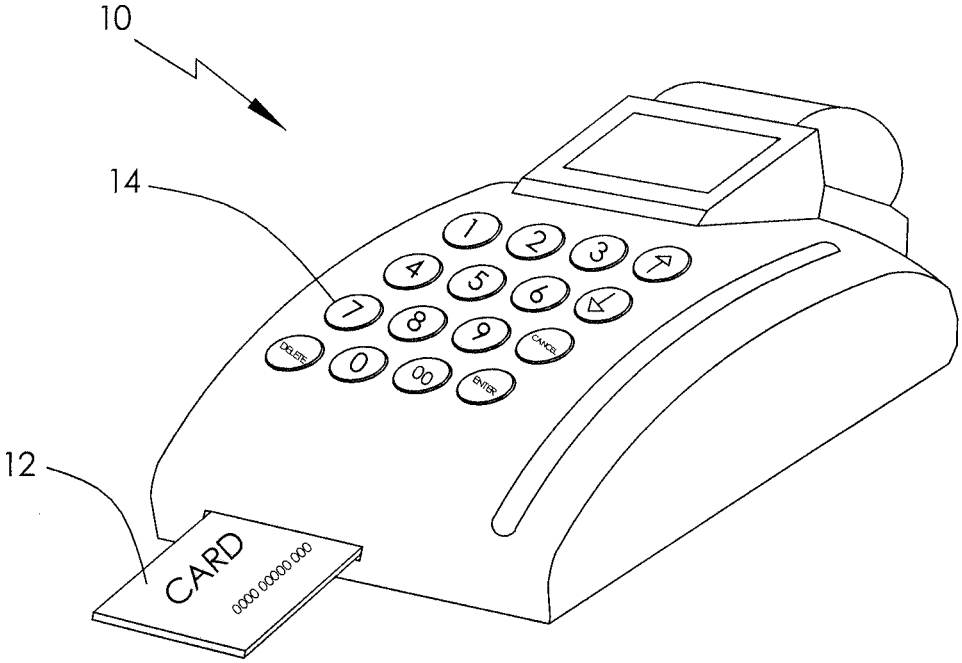
FIG. 1 illustrates a point of sale (POS) device as an example of an electronic device having a key pad.

FIG. 1 illustrates a point of sale (POS) device 10 as an example of an electronic device having a key pad 14 and an electronic circuit board and where a security device is used to indicate or prevent tampering with the electronic circuit board. The POS device 10 has a slot for receiving a card 12, such as a credit card containing confidential information. The key pad 14 has actuation elements, such as buttons or keys, for entering information and instructions for controlling the device 10. Inside the POS device 10. There is an electronic circuit comprising a circuit board with a memory chip and/or a microprocessor (μM) which may contain or momentarily have access to confidential information in the card 12. The security device may be placed over the entire circuit board or over just a portion of the board, depending on system requirements. The preferred security device is a security wrap which has a security screen formed on a flexible substrate as described herein after. The flexible substrate makes it more convenient to wrap the security device around a circuit to be protected.

Figure 2:
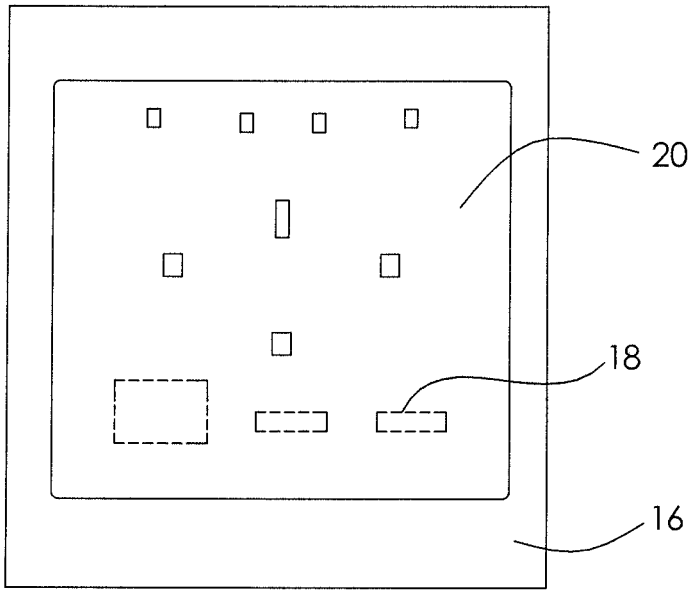
FIG. 2 illustrates a plan view of a PCB being a part of the POS device of FIG. 1, fitted with a security device according to the present invention.

FIG. 2 illustrates a security wrap 20 as an open face version covering a large portion of a printed circuit board (PCB) 16 of the POS device 10. The PCB 16 forms the parent device to be protected and the security wrap 20 is bonded to the PCB 16. Electronic components or devices mounted on the PCB 16 are generally indicated by reference numeral 18. By way of example, the electronic devices 18 are mounted on the surface of the PCB remote from the key pad 14 and security wrap 20. Security wrap 20 covers tracks on the side of the PCB 16 adjacent the key pad 14 and connecting to the electronic devices 18.

Figure 3:
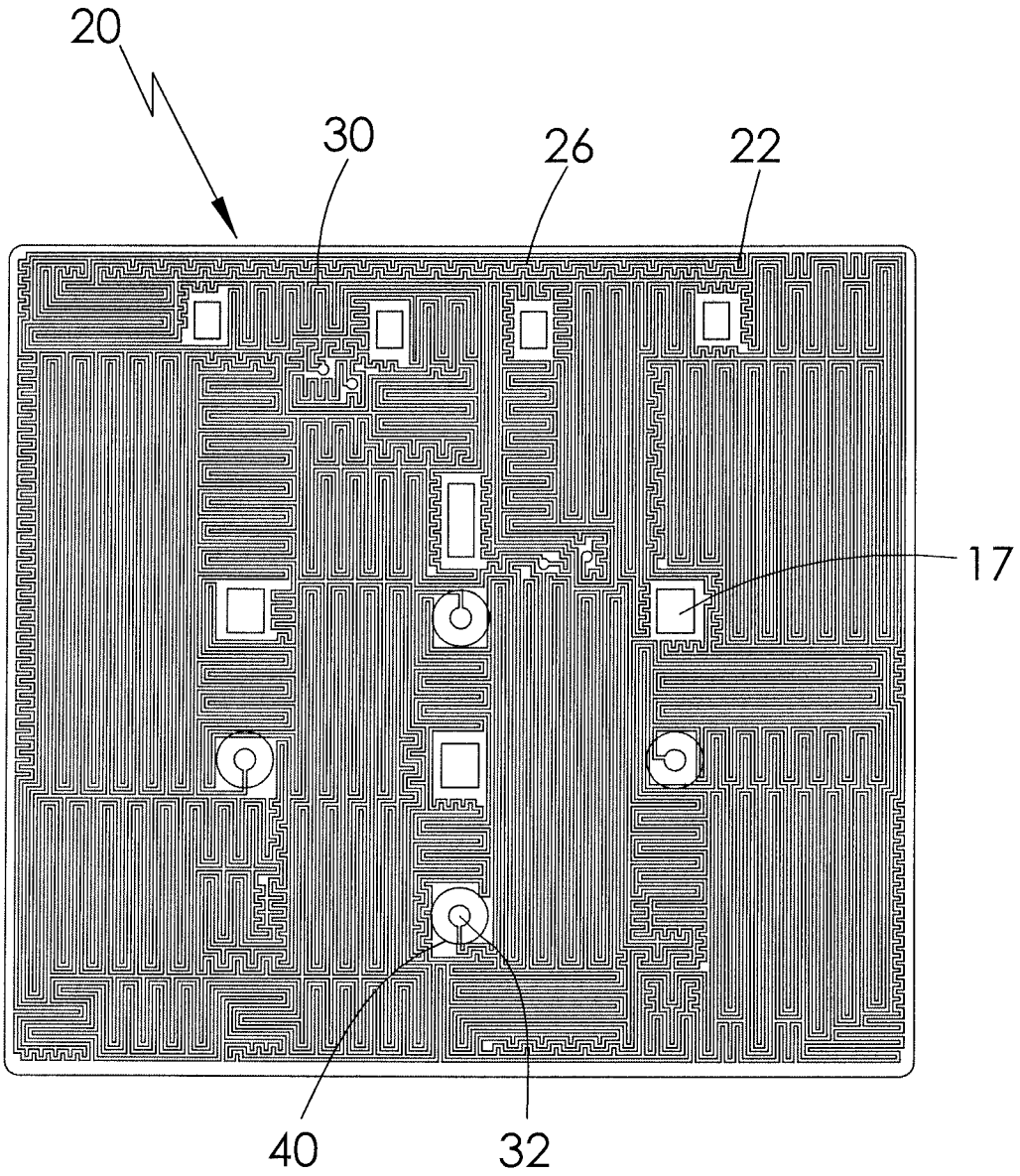
FIG. 3 illustrates an inside view of the security device of FIG. 2.

FIG. 3 illustrates the reverse side of the security wrap 20 having a security screen 30 including conductors or conductive traces 26 and screen terminals 32 that are visible due to the use of a transparent adhesive layer. In the embodiment illustrated, there are two conductive traces 26 and four screen terminals 32. Each screen terminal 32 has a conductive element, generally indicated by a circle labelled 40 for electrically connecting the screen terminal 32 to the screen contacts on the PCB 16.

Figure 4:
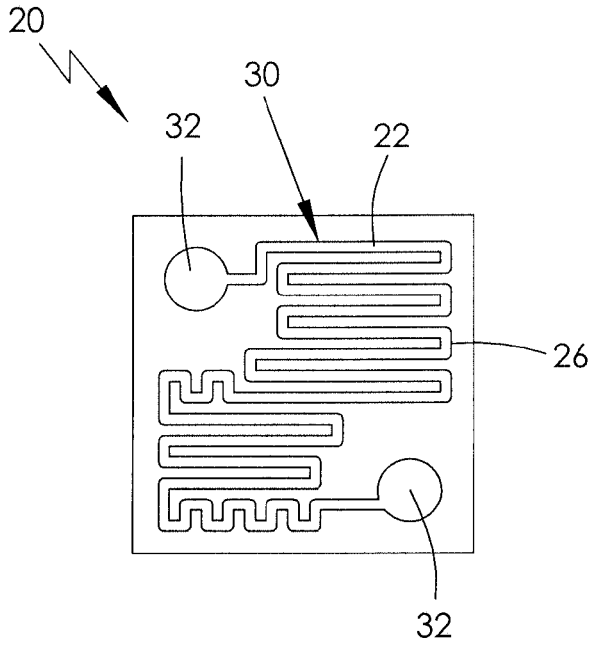
FIG. 4 illustrates a view of a simplified explanatory example of a security screen as used in the security device of FIG. 3.

FIG. 4 illustrates an explanatory example of the security wrap 20 to explain the concept of the security screen 30. The security screen 30 includes a conductive track or trace 26 for detecting an attempt to cut or drill through the security wrap 20. The security screen 30, in its most simple form, comprises the conductive trace 26 formed on the substrate 22 and interconnecting two screen terminals 32. The screen terminals 32 are, in use, electrically connected to alarm terminals of the parent device such that a change in the resistance of the security screen 30 would trigger an alarm condition. The response to the alarm condition depends on user requirements. The change in resistance may be going from closed circuit to open circuit, although more complex detection circuits may be used to detect a change in the resistance outside a predetermined range to detect an attempt to bypass the security screen 30 circuit. Preferably, the conductive trace 26 meanders over the surface of the substrate 22 according to a predetermined pattern forming a mesh of fine lines separated by fine gaps. The finer the lines and gaps, the greater the level of protection against holes being formed in the substrate 20 by drilling or cutting without cutting the security screen 30. Lines and gaps as fine as 150 micrometers (μm) are currently envisaged.

Figure 5:
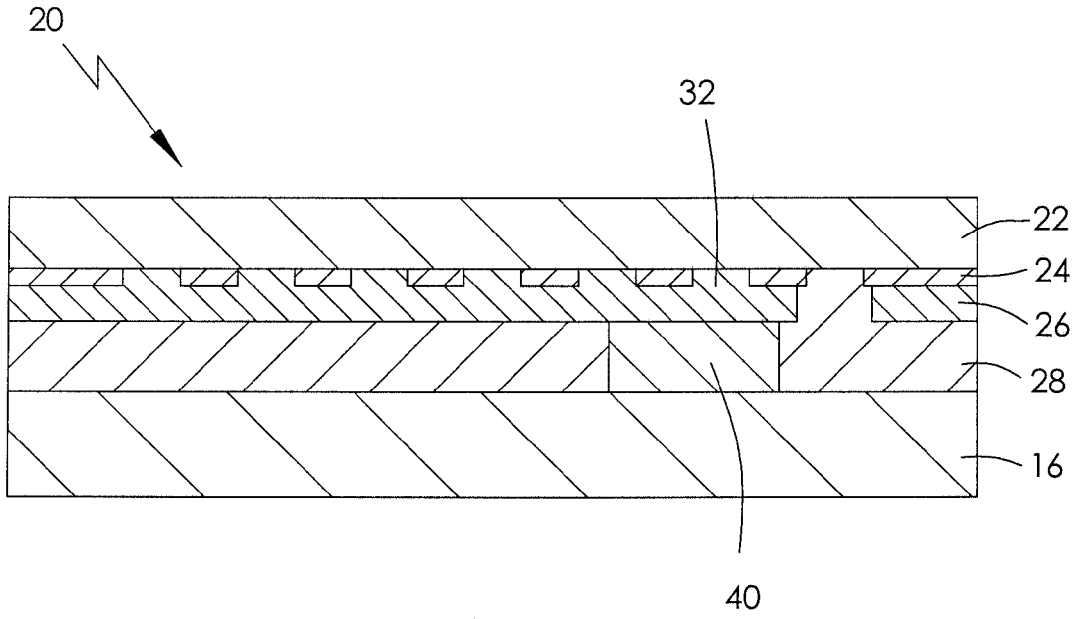
FIG. 5 illustrates an enlarged sectional view of a portion of the security device of FIG. 2.

FIG. 5 illustrates a sectional view of a portion of a security wrap 20 assembled to a parent device, i.e. the PCB 16 according to an embodiment of the present invention.

The main components of the security wrap 20 include the flexible substrate 22, a release layer 24, a conductive mesh layer or screen 30 formed by one or more conductive traces 26, and an adhesive layer 28.

In accordance with a preferred embodiment, the substrate 22 includes a polymer film, typically a polyethylene terephthalate (PET or commonly referred to as polyester) film, that provides a base for the security wrap 20. Optionally the substrate 22 is flexible, being a film of thickness between 25 μm and 175 μm but can be thicker or thinner depending on functional requirements and may include other variants of polymer film including, but not limited to, polycarbonate, PEN, polyimide, PVC. The substrate 22 may be clear or opaque and pigmented, for example black or white. Black is preferred, to hide the layout of the security screen 30.

The release layer 24 is applied to the substrate 22 in an intermittent pattern and is used to modify or vary the bonding strength of the security screen 30 to the substrate 20 in various regions. Preferably, the release layer 24 is applied in a printing process. Typically, the release layer 24 reduces the strength of the bond between the substrate 22 and the security screen 30. This creates a region prone to destruction should one attempts to peel the security wrap 20 off the parent device 16. In accordance with a preferred embodiment, the release layer 24 is an ultra-violet (UV), infra-red (IR), or thermally cured ink system used to provide a different adhesion level between the substrate 22 and the security screen traces 26. The ink is thus an adhesion modifier. The release layer 24 is not a complete layer such that there are areas of substrate 22 that are not covered by the adhesion modifier 24. Optionally, the release layer 24 may have such patterns as simple stripes or dots.

Preferably, the conductive trace 26 is formed by a thermo set or thermoplastic conductive ink printed over the substrate 22 and release layer 24, in variable trace widths and serpentine mesh patterns forming an electrically conductive path between a pair of screen terminals 32. A single layer security screen 30 may have one, two or more conductive traces 26 interconnecting respective pairs of screen terminals 32. A thermo set conductive ink is preferred for applications requiring a stable resistance between the screen terminals 32.

The conductive ink may be an ink containing silver, carbon, a combination of sliver and carbon, a clear conductive polymer, or other conductive or resistive inks, each with specific properties that suit the necessary requirement for the operation and functionality of the security wrap 20. Multiple layers of ink can be printed in total isolation or connected at specific points depending on the intended functionality of the security wrap 20.

The adhesive layer 28 is preferably a pressure-sensitive adhesive (PSA), typically an acrylic adhesive that forms a bond between surfaces when pressure is applied. The adhesive layer 28 is used to bond the security wrap 20 to the parent device 16. Alternatively, the adhesive may be a liquid adhesive, such as an epoxy, or moisture-cure urethane etc. dispensed or printed between the security wrap 20 and the PCB 16, which is then cured by moisture, thermal or UV and forms a permanent bond between the security wrap 20 and the PCB 16. This type of adhesive is not pressure sensitive, but could work under the same disclosed principle.

Depending on the material of the parent device 16 to which the security wrap 20 is adhered, a variant PSA with specific adhesion properties can be used. This can be a bespoke PSA specifically developed for a specific bonding requirement. Specifically the adhesion to the parent device 16 must be stronger than the adhesion of the release layer 24 to the substrate 22, so that on separation of the security wrap 20 from the parent device 16, part of the adhesive layer 28 will remain adhered to the parent device 16 and part of the adhesive layer 28 will remain adhered to the substrate 22 in order to break the conductive traces 26 of the security screen 30.

FIG. 5 illustrates a cross-section view of the security wrap 20 showing portions of the conductive trace 26 and screen terminal 32. Connection between the terminal 32 and a conductive track of the PCB 16 (not shown) is achieved by a conductive member or plug 40 disposed in a gap in the adhesive layer 28 and bridges the thickness of the adhesive layer 28 to form a conductive path through the adhesive layer 28, thereby electrically connecting the screen terminal 32 formed at an end of the conductive trace 26 to the alarm circuit of the PCB 16. The conductive plug 40 may be a carbon pill, a conductive pad, a conductive adhesive or a built-up layer of conductive ink.

Figure 6:
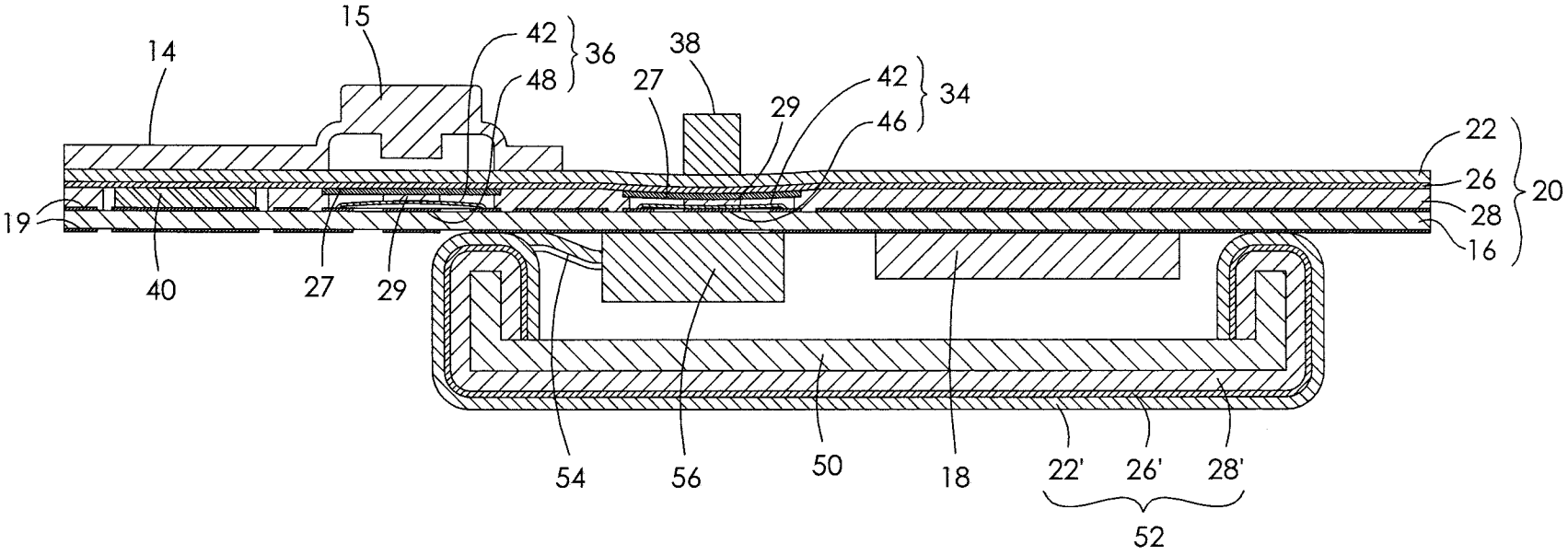
FIG. 6 illustrates a sectional view of a portion of a PCB fitted with a key pad and a security device in accordance with the present invention.

FIG. 6 is a sectional view of a portion of a parent device in the form of a PCB 16 fitted with a security device in the form of a security wrap 20 that overlays or covers the upper surface of PCB 16. A key pad 14 is fixed to the upper surface of the security wrap 20 and arranged to operate key switches 36. Apart from the conductive plug 40, the adhesive layer 28 has additional spaces in which switch elements are located. In accordance with a preferred embodiment, domes 42, made of metal and arranged to be resiliently deformed are disposed in the additional spaces in the adhesive layer 28. The domes 42 form switch elements arranged to be pressed against the PCB 16 to electrically connect together respective pairs of switch contacts formed by tracks on the PCB 16.

The PCB 16 supports at least one alarm switch 34 and at least one key switch 36 (16 keys are shown in the device 10 of FIG. 1, each requiring a respective key switch). The alarm switch 34 has a pair of alarm contacts 46 formed on the PCB 16. A dome 42 electrically interconnects the two alarm contacts 46 when depressed (as shown in FIG. 6), with an adhesive 29 fixing the dome 42 to the security device 20 while a discreet dielectric pad 27 insulates it from the conductive trace 26 of the security screen 30. A spigot 38 holds the alarm switch closed by depressing the dome 42. Upon removal of the spigot 38, the dome 42 resiliently returns to its original shape as illustrated in the key switch 36, thereby opening the alarm contacts 46 to signal an 'open case' alarm condition. Preferably, the spigot 38 is integrally formed with the housing, ideally a cover portion of the housing, such that opening of the housing moves the spigot 38 away from the alarm switch 34 to trip the alarm. In another embodiment, the spigot 38 is disposed under a dummy key of the key pad. The dummy key depresses the dome 42 in the alarm switch 34 through the spigot 38 while the housing is closed. In addition, when an authorized person needs to open the housing, for example, for maintenance purpose, the authorized person may use a special tool to keep the dummy keep in place to avoid tripping the alarm.

FIG. 6 shows one key switch 36 in the open or undepressed condition. The key switch 36 comprises a pair of input contacts 48 formed on the PCB 16 and a dome 42 arranged to electrically connect the two contacts 48 when deformed. A key 15 of the key pad 14 is arranged to resiliently deform the dome 42 through the security wrap 20 when depressed. The dome 42 is fixed to the security wrap 20 with adhesive 29 while a discrete pad 27 of a dielectric material prevents electrical contact between the dome 42 and the security screen 30 on the security wrap 20.

The present invention relates to the use of a security device, such as the security device 20 described above, with a separate alarm input which is triggered when the housing of the electronic device 10 is opened or when the circuit board 16 is removed from the housing. Separation of the 'open housing' alarm and the 'tampering' alarm allows for different responses to be possible. For example, opening the housing, for example, by removing a cover, may trigger an alarm response which puts the protected device 16 into a maintenance mode, whereas damaging a trace 26 of the security screen 30 may trigger an alarm response which deletes information stored in the device 16 or permanently disables the device 16.

FIG. 6 also shows a secondary security device 52 protecting the electronic component side of the PCB 16. A box 50, preferably of plastic, is arranged to cover the sensitive area of the PCB 16 that contain the electronic components. The secondary security device in the form of a second security wrap 52 is fixed to the box 50 and the assembly is fixed to the PCB 16. The second security wrap 52 may be similar in construction to the primary security wrap 20 disposed between the key pad 14 and the PCB 16. The security wrap 52 has a flexible substrate 22', a security screen formed by one or more conductive traces 26' formed on the substrate 22' and a layer of adhesive 28' to bond the security wrap 52 to the box 50. As an alternative to using the conductive passages through the adhesive layer 28' to connect to the parent device 16, a tag 54 is formed on a edge of the substrate 22', connected to the ends of the conductive traces 26' and forms a Zero Insertion Force (ZIF) type terminal, which mates with a ZIF type connector 56 fixed to the PCB 16 within the area covered by the box 50, so as to make contact with the alarm circuit of the PCB 16. Attempts to remove the security wrap 52 or cut through the box 50 will severe the security traces 26' and trigger an alarm condition. Therefore the reverse side of the PCB 16 is also protected against tampering. Alternatively, the reverse side of the PCB 16 may be secured by other methods such as by using a potting mix.

Optionally, the security wrap 20 may contain a dielectric layer. The dielectric layer includes preferably a UV curable ink system with electrically insulative properties and is used as a separating medium to permit multiple layers of conductive ink or multiple security screens 30 to be printed on a single substrate 22. It may also be used to protect the security screen 30 from coming into electrical contact with other components. For example, the dielectric layer may be applied directly over a first security screen via a printing process to insulate the first security screen from a second security screen or from other conductive circuit components, either of the security wrap 20 or the parent device 16. The dielectric layer is generally not necessary in a security wrap 20 having a single conductive layer, such that illustrated in FIG. 4, especially where the adhesive layer is non-conductive.

Depending on security wrap 20 functionality, the dielectric layer can be printed partially or fully over the top of the conductive traces 26 of a security screen 30 to enable a subsequent conductive layer (such as a second security screen) to be printed over but electrically isolated from the first expect where desired, for example to connect the traces in series. Multiple conductive/dielectric layers can be printed in succession.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

For example, a spacer, acting as a light guide or other function, may be disposed between the key pad 14 and the security device 20.

The invention claimed is:

1. An electronic device, comprising:

a housing including a cover;

a circuit board disposed within the housing and having at least one pair of input contacts and a pair of alarm contacts;

a key pad disposed on the cover of the housing and comprising at least one actuation element aligned with the at least one pair of input contacts on the circuit board;

an alarm circuit disposed on the circuit board and coupled to the pair of alarm contacts;

a security wrap interposed between the circuit board and the key pad and comprising:

a flexible substrate;

a security screen disposed on the flexible substrate and comprising a pair of screen terminals and an electrically conductive trace extending between the pair of screen terminals;

an adhesive layer covering the flexible substrate and bonding the flexible substrate to the circuit board, the adhesive layer being formed between the flexible substrate and the circuit board and including a plurality of openings that each extend from one side of the adhesive layer to another side of the adhesive layer;

a pair of conductive structures forming conductive paths extending through the adhesive layer to electrically connect the pair of screen terminals of the security screen to the alarm circuit; and a release layer formed between a portion of the flexible substrate and a corresponding portion of the security screen, the release layer modifying an adhesion between the portion of flexible substrate and the corresponding portion of the security screen to cause partial destruction of the security screen in response to the security wrap being removed from the circuit board;

at least one first dome disposed between the flexible substrate of the security wrap and the circuit board and aligned with the at least one actuation element, whereby depressing one of the at least one actuation element causes resilient deformation of one of the at least one first dome to electrically connect a corresponding one pair of the at least one pair of input contacts;

a second dome disposed between the flexible substrate of the security wrap and the circuit board and aligned with the pair of alarm contacts; and a spigot formed on the housing, aligned with the second dome and applying pressure on the flexible substrate to press the second dome against the pair of alarm contacts while the housing is closed, wherein the pair of conductive structures, the first dome and the second dome are formed inside respective ones of the plurality of openings of the adhesive layer, and wherein at least one first dome is fixed to the security wrap with an adhesive while a discrete pad of a dielectric material prevents electrical contact between the at least one first dome and the security screen on the security wrap.

2. The electronic device of claim 1, wherein the second dome is arranged to be resiliently deformed to short circuit the pair of alarm contacts.

3. The electronic device of claim 1, wherein the security wrap further comprises:

a dielectric layer disposed over the security screen remote from the flexible substrate; and a second security screen disposed over the dielectric layer.

4. The electronic device of claim 1, wherein the pair of conductive structures is selected from the group consisting of a carbon pills, a conductive pad, a pillar of conductive ink, and a column conductive adhesive.

5. The electronic device of claim 1, wherein the spigot is disposed under a dummy actuation element of the key pad.

6. The electronic device of claim 1, wherein the spigot is formed as an integral part of the cover of the housing.

7. The electronic device of claim 1, further comprising a second security wrap coupled to the alarm circuit and disposed over a side of the circuit board remote from the security wrap.

8. The electronic device of claim 7, wherein the second security wrap comprises a second security screen comprising a second pair of screen terminals coupled to the alarm circuit and a second electrically conductive trace extending between the second pair of screen terminals.

9. The electronic device of claim 8, further comprising a casing covering the side of the circuit board remote from the security wrap, wherein:

the alarm circuit includes a zero insertion force socket; and the second security wrap further includes:

a second flexible substrate, wherein the second security screen is disposed on the second flexible substrate;

an adhesive layer covering the second flexible substrate and bonding the second flexible substrate to the casing; and the pair of conductive structures forming conductive paths that electrically connect the second pair of screen terminals of the second security screen to the zero insertion force socket of the alarm circuit.

10. The electronic device of claim 1, further comprising a light guide, disposed between the circuit board and the key pad and having at least one opening accommodating the at least one actuation element of the key pad.

11. An electronic device, comprising:

a housing including a cover;

a circuit board, disposed within the housing and having a pair of alarm contacts;

an alarm circuit disposed on the circuit board and coupled to the pair of alarm contacts;

a security wrap interposed between the cover of the housing and the circuit board and comprising:

a flexible substrate;

a pair of screen terminals and an electrically conductive trace extending between the pair of screen terminals disposed on the flexible substrate;

an adhesive layer covering the flexible substrate and bonding the flexible substrate to the circuit board, the adhesive layer being formed between the flexible substrate and the circuit board and including a plurality of openings that each extend from one side of the adhesive layer to another side of the adhesive layer;

a pair of conductive structures forming conductive paths extending through the adhesive layer to electrically connect the pair of screen terminals to the alarm circuit; and a release layer formed between a portion of the flexible substrate and a corresponding portion of the electrically conductive trace, the release layer modifying an adhesion between the portion of flexible substrate and the corresponding portion of the electrically conductive trace to cause partial destruction of the electrically conductive trace in response to the security wrap being removed from the circuit board;

a first dome disposed between the security wrap and the circuit board and aligned with the pair of alarm contacts; and a spigot formed on the housing, aligned with the first dome and applying pressure on the flexible substrate of the security wrap to press the first dome against the pair of alarm contacts while the housing is closed, wherein the pair of conductive structures, the first dome and the second dome are formed inside respective ones of the plurality of openings of the adhesive layer, wherein the first dome is fixed to the security wrap with an adhesive while a discrete pad of a dielectric material prevents electrical contact between the first dome and a pair of screen terminals or an electrically conductive trace of the security wrap.

12. The electronic device of claim 11, further comprising:

at least one pair of input contacts disposed on the circuit board;

a key pad disposed on the cover of the housing and comprising at least one key aligned with the at least one pair of input contacts; and at least one second dome disposed between the security wrap and the circuit board and aligned with the at least one key, wherein the at least one second dome deforms to electrically connect the at least one pair of input contacts in response to the at least one key being depressed.

13. The electronic device of claim 11, further comprising:

a casing covering a side of the circuit board remote from the security wrap; and a second security wrap bonded to the casing and comprising a second conductive trace coupled to the alarm circuit.

14. The electronic device of claim 13, further comprising a zero insertion force type socket disposed on the circuit board and coupled to the alarm circuit, wherein the second security wrap further includes:

a second flexible substrate, wherein the second conductive trace is disposed on the second flexible substrate;

an second adhesive layer covering the second flexible substrate and bonding the second flexible substrate to the casing; and a tag electrically coupling two ends of the second conductive trace to the zero insertion force type socket.

15. The electronic device of claim 11, wherein the pair of conductive structures is selected from the group consisting of a carbon pill, a conductive pad, a pillar of conductive ink, and a column of conductive adhesive.

16. The electronic device of claim 12, wherein the spigot is disposed under a dummy key of the key pad.

17. The electronic device of claim 11, wherein the spigot is formed as an integral part of the cover.

18. The electronic device of claim 11, wherein the security wrap further comprises:

a dielectric layer disposed over a side of the flexible substrate, remote from the adhesive layer and covering the electrically conductive trace extending between the pair of screen terminals;

a second electrically conductive trace disposed over the dielectric layer; and a second conductive structure forming a conductive path extending through the dielectric layer and coupling second electrically conductive trace to the alarm circuit.

* * * * *